US006290115B1

(12) United States Patent
Chen

(10) Patent No.: US 6,290,115 B1
(45) Date of Patent: Sep. 18, 2001

(54) QUICK-RELEASE DEVICE FOR A PNEUMATIC NAIL GUN MAGAZINE

(75) Inventor: Ruey-Zon Chen, Ta Li (TW)

(73) Assignee: Rexon Industrial Corp., Ltd., Taichung Hsien (TW)

( * ) Notice: Subject to any disclaimer, the term of this patent is extended or adjusted under 35 U.S.C. 154(b) by 0 days.

(21) Appl. No.: 09/709,332

(22) Filed: Nov. 13, 2000

(51) Int. Cl.[7] ..... B25C 1/04
(52) U.S. Cl. ..... 227/120; 221/238; 221/279
(58) Field of Search ..... 227/119, 120, 227/136, 156, 130, 109; 221/279, 238, 227, 198

(56) References Cited

U.S. PATENT DOCUMENTS 5,322,189 * 6/1994 Oda ..... 227/120
5,335,800 * 8/1994 Liu ..... 227/120
5,588,577 * 12/1996 Chen ..... 227/109
6,012,622 * 1/2000 Weinger et al. ..... 227/109
6,053,389 * 4/2000 Chu et al. ..... 227/119
6,056,181 * 5/2000 Chuang ..... 227/120

* cited by examiner

*Primary Examiner*—Scott A. Smith
(74) *Attorney, Agent, or Firm*—Rosenberg, Klein & Lee

(57) ABSTRACT

A quick-release device for a pneumatic nail gun with a magazine has a base, a pusher plate, a spring and a button. The base has a through hole defined in the top of the base. The pusher plate has a first end that normally extends into the channel of the magazine and a second end. The spring abuts the second end of the pusher plate. The button is moveably mounted in the base and extends out from the through hole. The button abuts the second end of the pusher plate, such that the pusher plate can be pivoted by pressing the exposed button. The finger of the user does not extend into the device. Consequently, the operation of the quick-release device is simplified, and the finger of the user will not be injured during the process of clearing jammed nails.

3 Claims, 5 Drawing Sheets

QUICK-RELEASE DEVICE FOR A PNEUMATIC NAIL GUN MAGAZINE

BACKGROUND OF THE INVENTION

1. Field of the Invention

The present invention relates to a quick-release device, and more particularly to a quick-release device for a pneumatic nail gun magazine to gain access to nails jammed in the magazine.

2. Description of Related Art

A pneumatic nail gun is used to join two objects by shooting a nail through both objects. With reference to FIG. 5, a conventional pneumatic nail gun comprises a hollow body (30), a handle (32), a barrel (34) and a magazine (36). A compressed air mechanism (not shown) is mounted in the body (30) to propel the nail. The handle (32) integrally extends from one end of the body (30). The barrel (34) is secured to the other end of the body (30). The magazine (36) is connected to the barrel (34). A channel is defined in the magazine (36) to receive the nails and communicate with the barrel (34), such that the nails can be pushed into the barrel (34) through the channel in the magazine (36) one after another.

A quick-release device is mounted on the magazine (36) to gain access to nails jammed in the magazine. With reference to FIGS. 5 and 6, the quick-release device in accordance with the prior art comprises a base (40), a pusher plate (42) and a spring (44). The base (40) is slidably mounted on the magazine (36). The pusher plate (42) is pivotally mounted in the base (40). The pusher plate (42) has a first end extending into the channel of the magazine (40) to push the nails and a second end. The spring (44) abuts the second end of the pusher plate (42), such that the first end of the pusher plate (40) is held in the channel due to the force provided by the spring (44). A through hole (402) is defined in the top of the base (40) and aligns with the second end of the pusher plate (42).

When a nail blockage occurs, the user presses the second end of the pusher plate (42) with his or her finger by extending his or her finger through the through hole (402) in the base (40). The first end of the pusher plate (42) will pivot upward out of the channel when the second end is pressed by the user. Consequently, the nails can be released from the channel, and the nail blockage can be removed.

With such a conventional quick-release device, a finger of the user or a desired tool like a screwdriver must inserted through the through hole (402) to push the second end of the pusher plate (42). The operation of the conventional quick-release device is very troublesome. In addition, because the finger of the user must be held in the through hole (402) while the jam is cleared, the finger is easily injured.

To overcome the shortcomings, the present invention is intended to provide an improved quick-release device for a pneumatic nail gun magazine to mitigate or obviate the aforementioned problems.

SUMMARY OF THE INVENTION

The main objective of the quick-release device for a pneumatic nail gun magazine in accordance invention is to provide an improved quick-release device that is easily operated. The quick-release device has a base, a pusher plate, a spring and a button. The base has a through hole defined in the top of the base. The pusher plate has a first end that normally extends into the channel of the magazine and a second end. The spring abuts the second end of the pusher plate. The button is moveably mounted in the base and extends out from the through hole. The button abuts the second end of the pusher plate. By such an arrangement, the pusher plate will be pivoted when the user pushes the button that extends out of the base. The operation of the quick-release device is simplified, and the finger of the user will not be injured.

Other objects, advantages and novel features of the invention will become more apparent from the following detailed description when taken in conjunction with the accompanying drawings.

DETAILED DESCRIPTION OF PREFERRED EMBODIMENT

Figure 1:
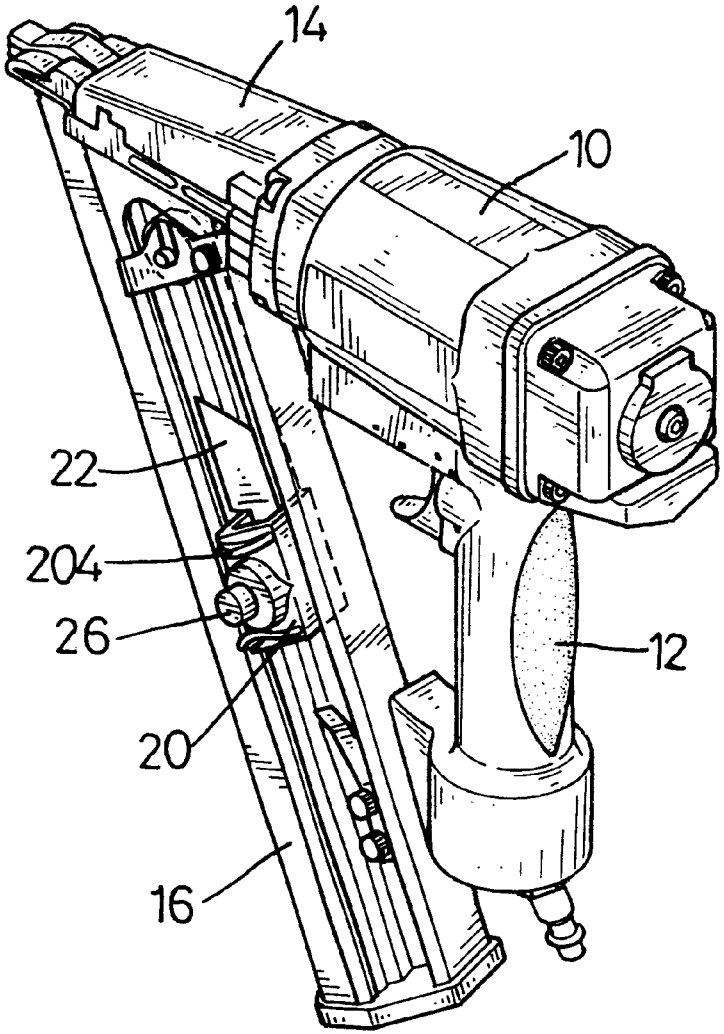
FIG. 1 is a perspective view of a quick-release device in accordance with the present invention with a pneumatic nail gun.
Figure 2:
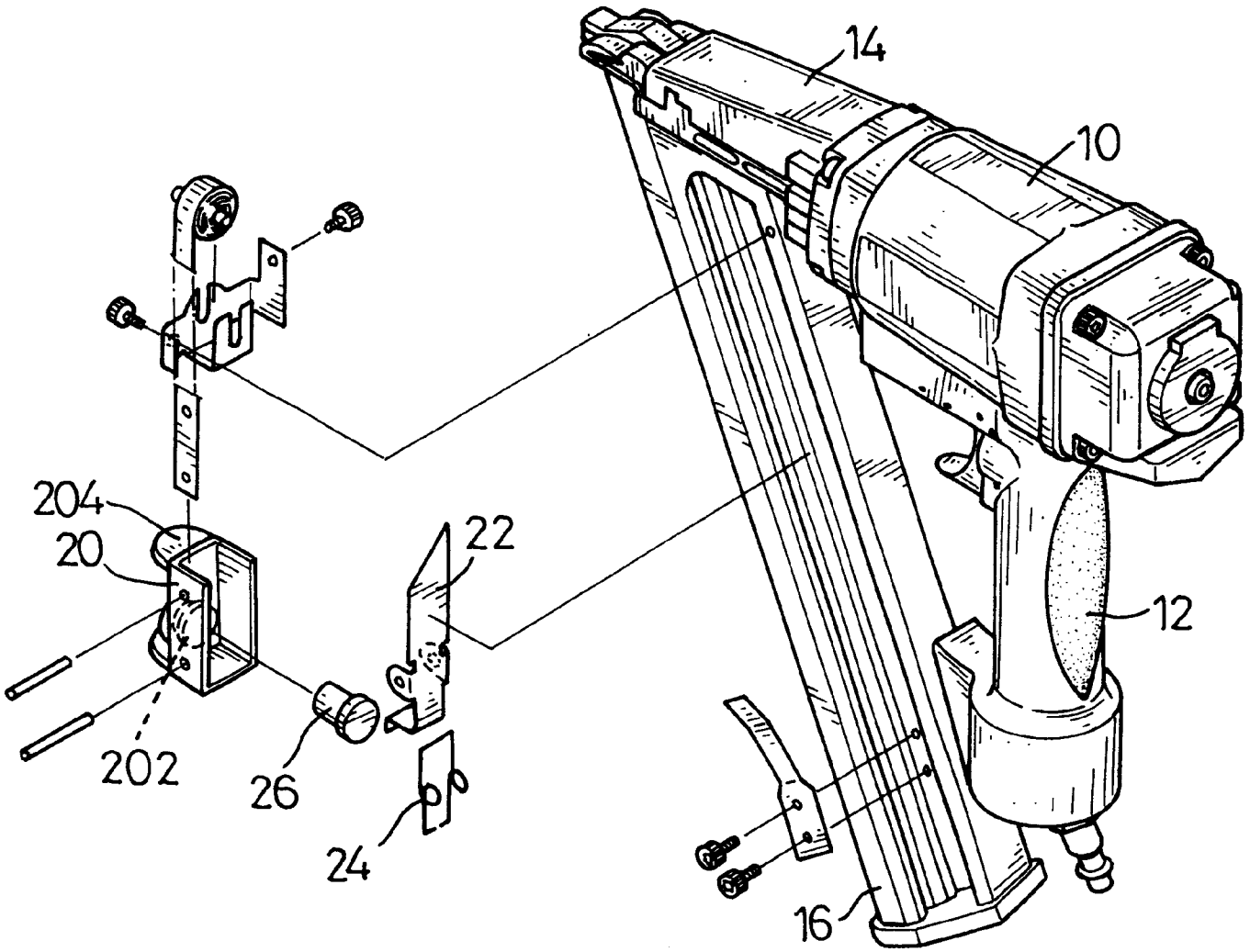
FIG. 2 is an exploded perspective view of the quick-release device in FIG. 1 with the pneumatic nail gun.
Figure 3:
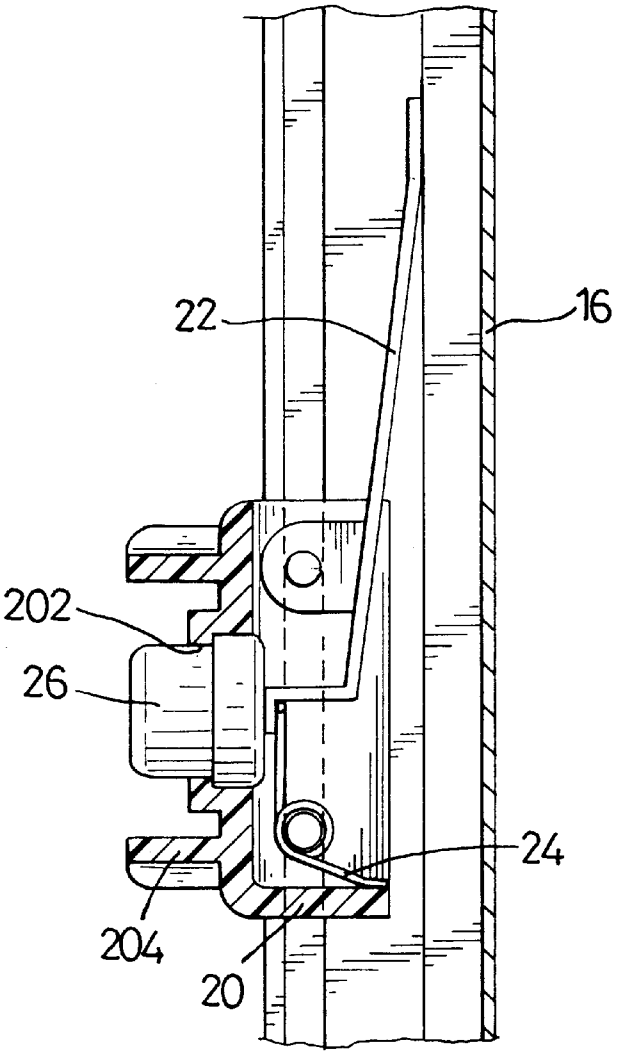
FIG. 3 is a front plan view in partial section of the quick-release device in FIG. 1.
Figure 5:
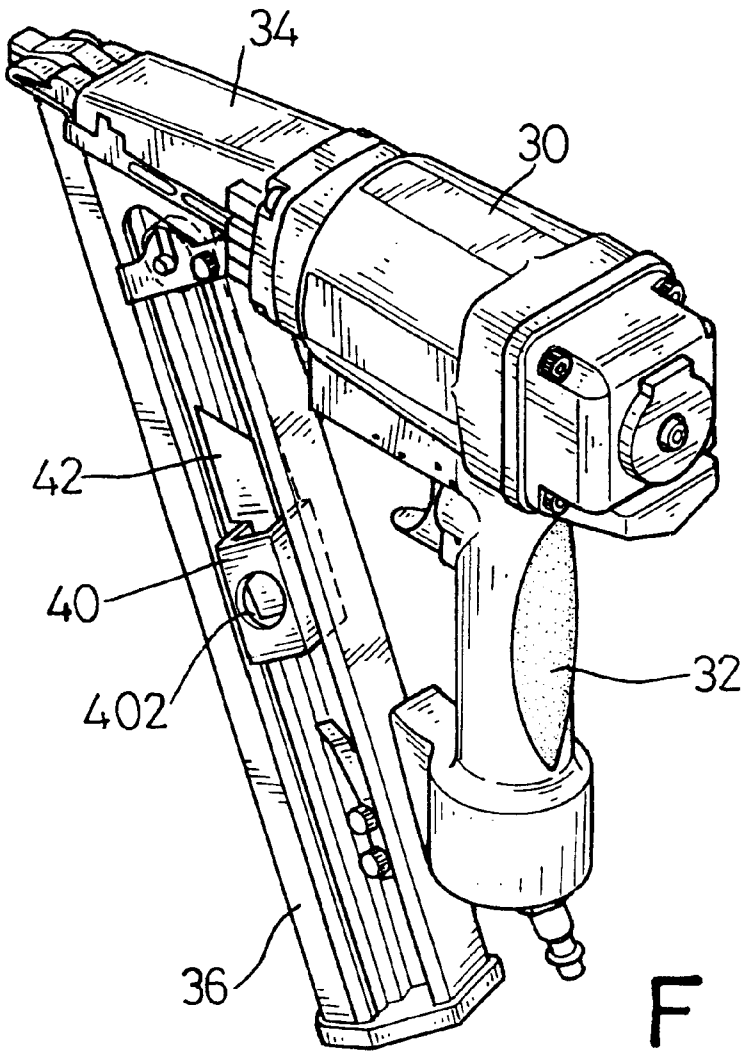
FIG. 5 PRIOR ART
FIG. 5 is a perspective view of a conventional quick-release device in accordance with the prior art with a pneumatic nail gun.
Figure 6:
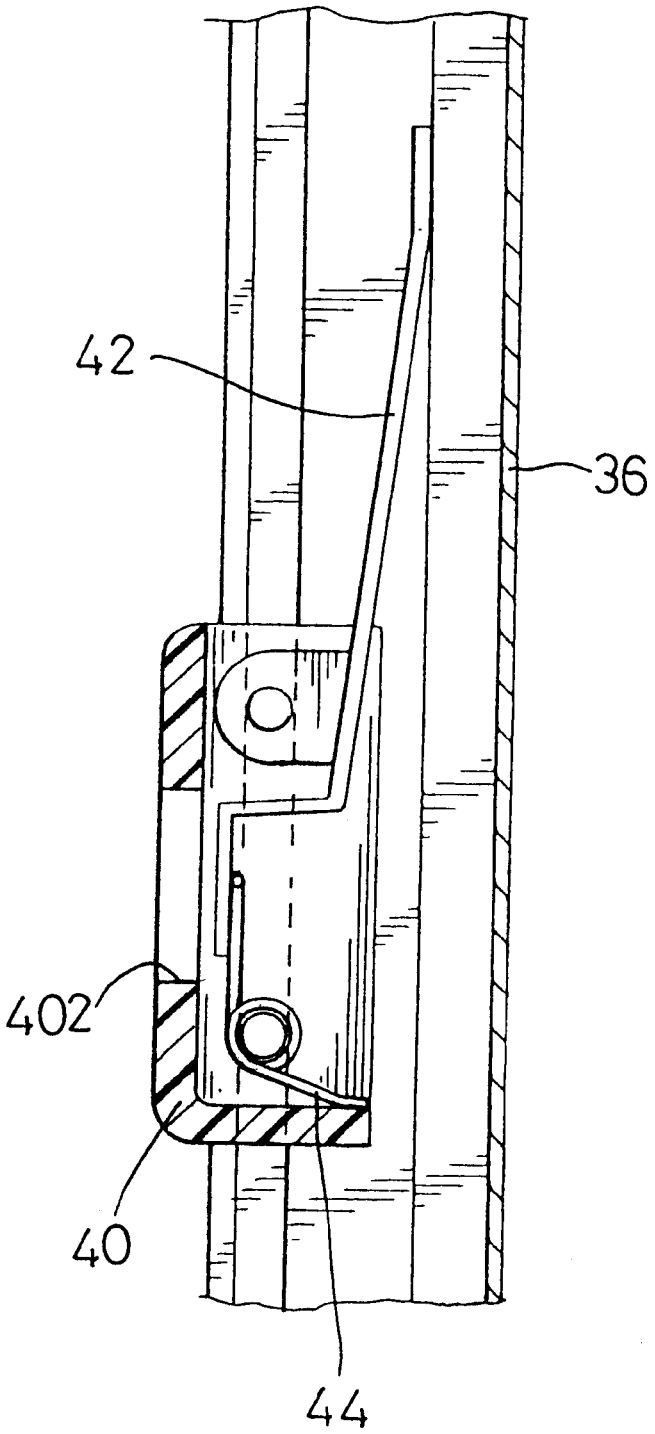
FIG. 6 PRIOR ART
FIG. 6 is a front plan view in partial section of the conventional quick-release device in FIG. 5.

With reference to FIGS. 1 to 3, a quick-release device in accordance with the present invention for a pneumatic nail gun having a body (10), a handle (12), a barrel (14) and a magazine (16) comprises a base (20), a pusher plate (22), a spring (24) and a button (26). The base (20) is adapted to be slidably mounted on the magazine (16) of a pneumatic nail gun. A through hole (202) is defined in the top of the base (20). The pusher plate (22) is pivotally mounted in the base (20). The pusher plate (22) has a first end that normally extends into the channel of the magazine (16) and a second end. The spring (24) abuts the second end of the pusher plate (22), such that the first end of the pusher plate (22) is normally held in the channel to push the nails. The button (26) is moveably mounted in the base (20) and extends out from the through hole (202). The button (26) abuts the second end of the pusher plate (22).

Figure 4:
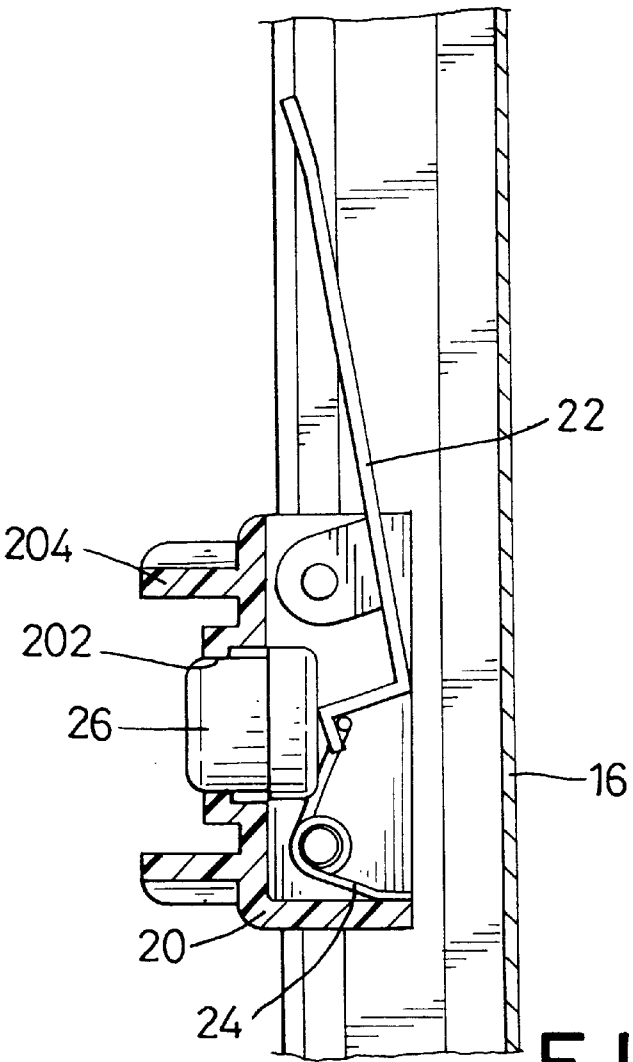
FIG. 4 is an operational front plan view in partial section of the quick-release device in FIG. 1.

With reference to FIG. 4, when a nail blockage occurs, the user just pushes the button (26). The first end of the pusher plate (22) will pivot out of the channel. The jammed nails can be released from the channel of the magazine (16), and the nail blockage can be cleared. Because the pusher plate (22) is activated by the exposed button (26), the finger of the user does not extend into the device, and no tool is needed to operate the quick-release device. Therefore, the operation of the quick-release device is simplified. In addition, the finger is not in a position to be injured by the quick-release device during the clearing process.

With reference to FIGS. 2 and 3, two ears (204) protrude from the top of the base (20) with one ear (204) above and below the through hole (202). The ears (204) are longer than the button (26) extending from the base (20). When the pneumatic nail gun is put on a flat object like a table or the ground, the ears (204) can keep the button (26) from being depressed. Consequently, the button (26) will not be inadvertently pushed when the nail gun is put down.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A quick-release device for a pneumatic nail gun having a body, a handle extending from one end of the body, a barrel mounted on the other end of the body, a magazine connected to the barrel and a channel defined in the magazine and communicating with the barrel, the device comprising:

a base adapted to be slidably mounted on the magazine and having a through hole defined in a top of the base;

a pusher plate pivotally mounted in the base and having a first end that normally extends into the channel of the magazine and a second end;

a spring abutting the second end of the pusher plate; and a button moveably mounted in the base, extending out from the through hole and abutting the second end of the pusher plate.

2. The quick-release device as claimed in claim 1, wherein two ears extend upward from the base with one on each side of the through hole.

3. The quick-release device as claimed in claim 2, wherein each ear is longer than the button extending out from the through hole.

* * * * *